US006289797B1

(12) United States Patent
Ijäs

(10) Patent No.: US 6,289,797 B1
(45) Date of Patent: Sep. 18, 2001

(54) METHOD FOR CALENDERING A PAPER WEB AND CALENDER APPLYING THE METHOD

(75) Inventor: Vesa Ijäs, Viiala (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/267,958

(22) Filed: Mar. 12, 1999

(30) Foreign Application Priority Data

Mar. 13, 1998 (FI) ..... 980557

(51) Int. Cl.[7] ..... B30B 3/04; D21G 1/00

(52) U.S. Cl. ..... 100/38; 100/153; 100/162 B; 100/313; 100/329; 100/334; 162/206

(58) Field of Search ..... 100/38, 153, 162 B, 100/313, 329, 334–336; 162/206, 207

(56) References Cited

U.S. PATENT DOCUMENTS

| | | | | |
|---|---|---|---|---|
| 3,162,568 | * | 12/1964 | Post | 162/206 |
| 4,233,011 | * | 11/1980 | Bolender et al. | 100/329 |
| 4,425,489 | | 1/1984 | Pav et al. . | |
| 4,498,383 | * | 2/1985 | Pav et al. | 100/329 |
| 4,535,230 | | 8/1985 | Brieu . | |
| 4,658,716 | | 4/1987 | Boissevain . | |
| 4,757,582 | | 7/1988 | Verkasalo . | |
| 4,796,525 | * | 1/1989 | Schiel et al. | 100/329 |
| 5,156,086 | | 10/1992 | Kiema et al. . | |
| 5,711,854 | * | 1/1998 | Schiel et al. | 100/336 |
| 5,896,813 | * | 4/1999 | Nikulainen et al. | 100/335 |

FOREIGN PATENT DOCUMENTS

| | | |
|---|---|---|
| 4203497 | 8/1993 | (DE) . |
| 0617165 | 9/1997 | (EP) . |
| 9741298 | 1/1997 | (WO) . |

OTHER PUBLICATIONS

English Translation of Derwent Abstract of EP 814196A.

* cited by examiner

*Primary Examiner*—Stephen F. Gerrity
(74) *Attorney, Agent, or Firm*—Steinberg & Raskin, P.C.

(57) ABSTRACT

Method in calendering of a paper web in which the paper web is conveyed through a calendering nip formed by two calender rolls, at least one of which is a soft-faced roll having a coating of a resilient or polymeric material, or over which a belt of resilient or polymeric material is directed and passed through the nip. The profile of the calendering nip is controlled to compensate for defects in the web entering the calender. The profile control is accomplished by changing the diameter of the soft-faced roll zonewise by a profile control device arranged inside the body and performing temperature profiling. The profile control device include temperature control elements such as heating elements located in zones for heating a heat transfer medium such as air supplied into the body.

17 Claims, 3 Drawing Sheets

METHOD FOR CALENDERING A PAPER WEB AND CALENDER APPLYING THE METHOD

FIELD OF THE INVENTION

The present invention relates to a method for calendering a paper web, wherein the paper web is conveyed through a calendering nip formed by two calender rolls. At least one of the calender rolls is a soft-faced roll including a coating of a polymeric or corresponding material or arranged so that a belt passes over the roll and runs through the nip. The profile of the calendering nip is controlled to compensate for defects in the web entering the calender. The present invention also relates to a calender comprising at least one calendering nip formed between two calender rolls, at least one of which is equipped with a resilient (soft) surface layer in the form of a coating or a belt brought over the roll and running through the nip. The calender is provided with at least one control device to control the profile of the calendering nip to compensate for defects in the web entering the calender.

BACKGROUND OF THE INVENTION

In the paper web entering the calender, there are variations due to functional inaccuracies in the wet end of a paper machine, i.e., the headbox, the forming section and the press section, and in the drying section. In addition to the primary function of the calender, i.e., the finishing of the surface properties of the web, the calender is also used to correct the above-mentioned inaccuracies in the quality of the web. Thus, the function of the calender must be adjustable, i.e., the profile of the calendering nip must be controllable to compensate for these defects.

Conventionally, the profile adjustment at the calender is conducted by changing the diameter of a metal-faced nipping roll or the nip force locally and/or by using so-called variable-crown rolls, whereby the nip force profile can be adjusted as desired. However, these rolls have a relatively large need for rotational power, due to sliding frictions inside the roll, and furthermore, the rolls are structurally very complicated and thereby also expensive to manufacture.

The change of the diameter is conventionally conducted by heating the mantle of the metal roll locally from the outside or cooling the mantle of the metal roll locally from the inside. Attempts in local heating of the roll mantle include, e.g., hot air blowing, infrared heating and various electric heating elements. Disadvantages of this local heating method include, however, the large size of the heating devices used in relation to the roll, and the need for separate supports and transfer devices. After a web break, cleaning up of the calender is rendered difficult by the small gap between the roll and the heat control device(s), web scraps being easily accumulated in the gap in connection with web breaks.

Another important drawback has been that a change in the diameter of the roll mantle has required relatively large temperature differences, wherein even large variations have been possible in the temperature of the nipping roll in the axial direction. This, in turn, has clearly affected the gloss of the paper, i.e., more glossy and less glossy stripes may have occurred in the paper web.

With respect to related prior art, reference is made to U.S. Pat. No. 4,658,716 which describes a calender roll equipped with several infrared heaters spaced from each other in the axial direction of the roll. The purpose of the infrared heaters is to adjust the diameter of the calender roll to compensate for cross-directional variations in the paper web entering the calender nip. In other words, the profile of the calender nip is adjusted by heating the metal roll from the outside. However, problems associated herewith are generated, as discussed above.

Furthermore, as an example of one method according to the prior art, reference is made to a method described in Finnish Patent Application No. 961816, (corresponding to International Publication No. 97/41298) wherein the local properties of the polymeric surface are influenced by heating and cooling the coating with an external temperature control device.

An example of internal heating of the roll mantle in zones is described in Finnish Patent Publication No. FI 70358, which corresponds to German Patent Application No. DE 3033482 and U.S. Pat. No. 4,425,589.

OBJECTS AND SUMMARY OF THE INVENTION

It is an object of the present invention to provide a novel method in calendering of a fibrous web as well as a calender applying the method.

It is another object of the present invention to provide a novel method in calendering of a paper web and calender in which drawbacks related to the prior art, e.g., as discussed above, are avoided.

It is yet another object of the present invention to provide a novel method for calendering a paper web and calender which provides improved control of the profile of the calender nip.

In order to achieve these objects, and others, in a method in accordance with the invention, the nip force profile is controlled during operation of the machine by zonewise changing the temperature of the tube used as the body of the soft-faced roll in the cross machine direction in a controlled manner by means of external and internal temperature profiling devices of the metal-surface rolls.

A calender in accordance with the invention includes a profile control device arranged in connection with, and preferably inside of, a calender roll equipped with a soft surface layer and which profile control device is arranged to change the temperature of the tubular body of the roll in the cross machine direction and thereby the local diameter thereof.

By adjusting the temperature of the roll body, a small local difference in the temperature produces a significant profiling effect, as shown by the following calculation example. Assuming a polymer roll having a diameter of about 735 mm, metal body wall thickness of about 100 mm and polymer coating thickness of about 25 mm, if in such a roll there is a temperature difference of about 50° C. between two adjacent areas in the body and the coating, then the diameter of the polymer roll is approximately 65 $\mu$m greater in the warmer area. The coefficient of thermal expansion of the body is approximately 1.17 E-05 1/° C., and the coefficient of the coating, as is typical for polymer materials, is higher, about 5.0 E-05 1/° C. With a densely-zoned zonewise adjustable roll used today, it is possible to achieve an equivalent diameter change of only a few 10 $\mu$m.

In the following, an advantageous embodiment of the invention will be described in more detail. The local heating/cooling of the body of the polymer roll can be accomplished by a cool air blowing through a blow nozzle (e.g., filtered hall air which is air from the machine hall in which the calender is situated), in which every zone is provided with a respective controllable electric resistor. The minimum width of the zone is determined, in practice, by the width of the electric resistor. Thus, it is possible to adjust the blowing temperature in different zones (for example from about 30° C. to about 70° C.). When the air is blown at a rate of about 10 m/s to about 200 m/s, preferably from about 30 m/s to about 60 m/s, towards the inner body of the roll, the air provides good heat transfer properties (from about 200 $W/m^{2\circ}$ C. to about 350 $W/m^{2\circ}$ C.) to the body. The blowing of air is preferably implemented on a narrow sector in the direction of the periphery of the roll in order to avoid the need of excessive air quantities. During the blowing, the polymer roll rotates all the time. It is advantageous to bring the air to the roll through the first end to the inside of the polymer roll, and to remove it through the second end. In addition to the blow nozzle, each control zone is advantageously provided with a suction nozzle to remove the air used in the area of the zone and to prevent its entry to the area of other zones. The control of the electric resistors can be coupled to the gloss or thickness profile control. Furthermore, the heating can be implemented by heating the roll body inductively, in a zonewise controlled manner, or uniformly over its full length.

A heating device which is suitable for controlling the temperature and thereby the diameter profile of the roll according to the invention can also be used to maintain a basic temperature in the roll body. This will prevent the conduction of heat, produced by a deformation of the coating in the nip, from the coating to the roll body, and even heat the polymer coating from the inside so that its temperature also in the area of the coating lying against the web is higher than can be produced by thermal energy flows developed only by internal friction, web temperature and the surface temperature of the roll acting as the counter roll. Thus, the polymer roll can be considered to act in the same way as a so-called thermo-roll which works the surface structure of the web with the combined effects of high temperature and nip pressure, and it is possible to achieve a two-sided smoothing effect on the web surface, as mentioned in Finnish Patent Nos. FI 87815 and FI 85894 (both corresponding to U.S. Pat. No. 5,156,086). In the case described above, the temperature of the roll coating can be raised as high as to the so-called glass transition temperature Tg of the coating material, but preferably about 20° C. below the same, wherein an occasional local temperature rise will not cause damage in the coating.

The invention provides considerable advantages over the prior art, and the benefits of the invention include, e.g., the fact that a local profile adjustment in the axial direction can be performed in a simpler manner. This is because the required temperature control devices are placed inside the roll and they are thus protected in possible events of disturbance and during other maintenance of the machine, such as during roll exchanges, and they do not require separate supports or transfer devices to make it possible to remove web material during web breaks or to clean the rolls.

The invention affords considerable advantages over the prior art also in that when the temperature of the metal roll body as well as of the coating is acted upon locally in relation to the longitudinal axis of the roll, a greater profiling effect is achieved with the same local temperature difference or preferably the same profiling effect with a smaller temperature difference. An additional benefit particularly in the latter case is that a more even and uniform web surface treatment is obtained, and thereby smaller variations in gloss in the width direction of the web with the same improvements in the thickness profile.

Other advantages and characteristics of the invention will be disclosed in the following detailed description of the invention.

In the following, the invention will be described in detail with reference to some exemplifying embodiments of the invention illustrated in the figures in the accompanying drawing. However, the invention is by no means strictly confined to the details of the illustrated embodiments alone.

BRIEF DESCRIPTION OF THE DRAWINGS

In the following, the invention will be described by way of an example with reference to the figures in the appended drawings, wherein.

DETAILED DESCRIPTION OF THE PREFERRED EMBODIMENTS

Figure 1:
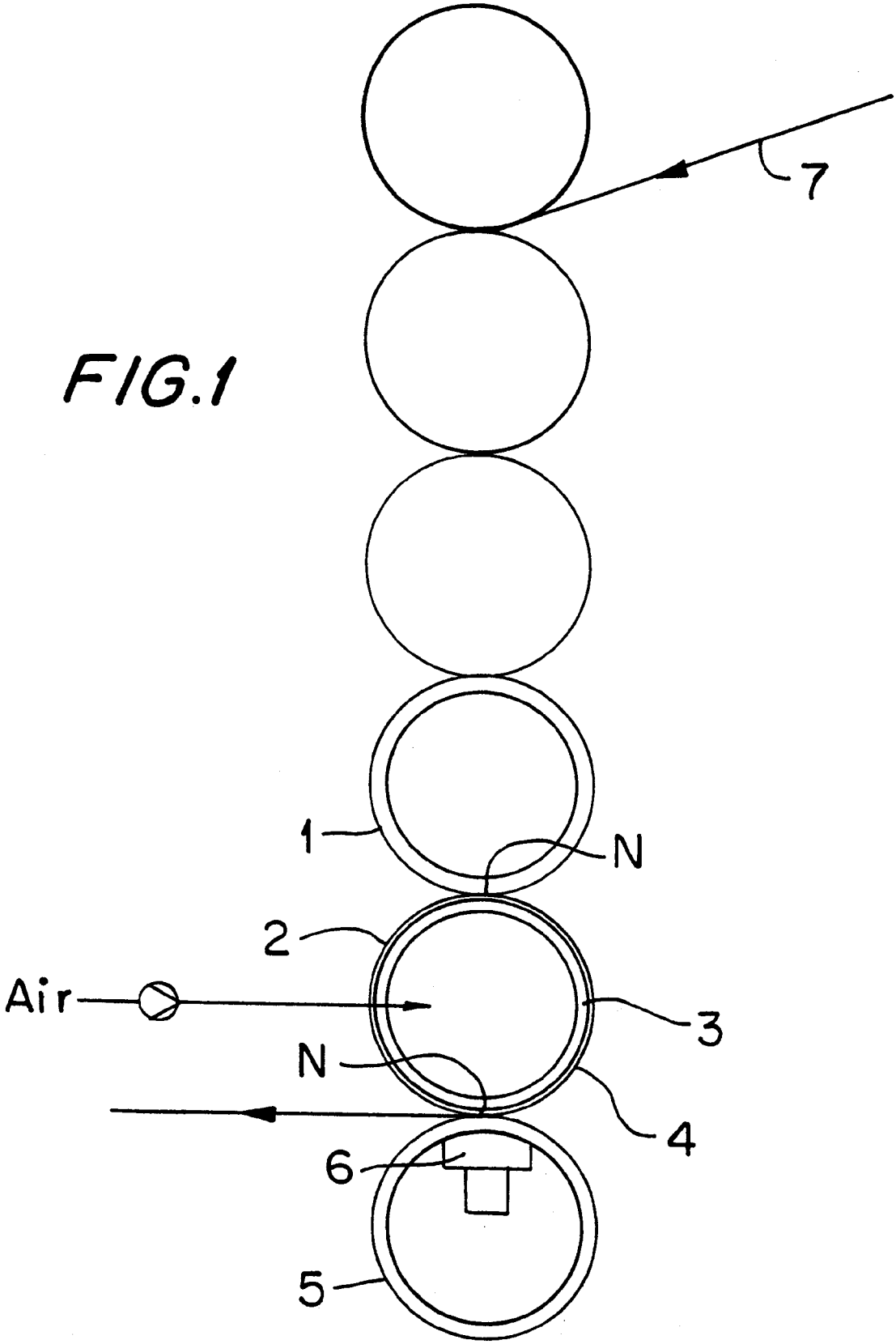
FIG. 1 is a schematic view showing a multi-roll calender, in which some of the calender rolls are equipped with a coating.

Referring to the accompanying drawings wherein the same reference numerals refer to the same or similar elements, FIG. 1 shows a calender including a roll according to the invention which is designated by reference numeral 2. The calender is a multi-nip calender having calender rolls disposed in a roll stack, and a paper web 7 to be treated enters the calender stack at the uppermost nip formed between two uppermost calender rolls, and after having passed successive nips formed between the calender rolls the web leaves the stack at the lowermost nip formed between two lowermost calender rolls. In this embodiment, the roll 2 is placed so that nips N for treating the web 7 are formed on opposite sides thereof. As such, the roll 2 is positioned between two rolls 1, 5 supporting it directly and conforms to their general deflection form. Since in the calender according to the invention the profiling takes place by changing the local diameter of a body or body part 3 of the roll 2, one profile control device can in this advantageous case provide two nips profiled substantially in substantially the same way. If at least one of the rolls 1,5 immediately adjacent to the roll 2 to be profiled is a zone-adjustable roll, such as the lower roll 5 as shown in FIG. 1, by means of an actuator 6 installed therein (a profile control device), it is possible to profile the nip force directed at the web 7 separately by one, or alternatively by both simultaneously, of the profile control devices in use, wherein the joint effect of these can be utilized so that the profiling effect is stronger than the effect of either of the control devices separately.

Figure 2:
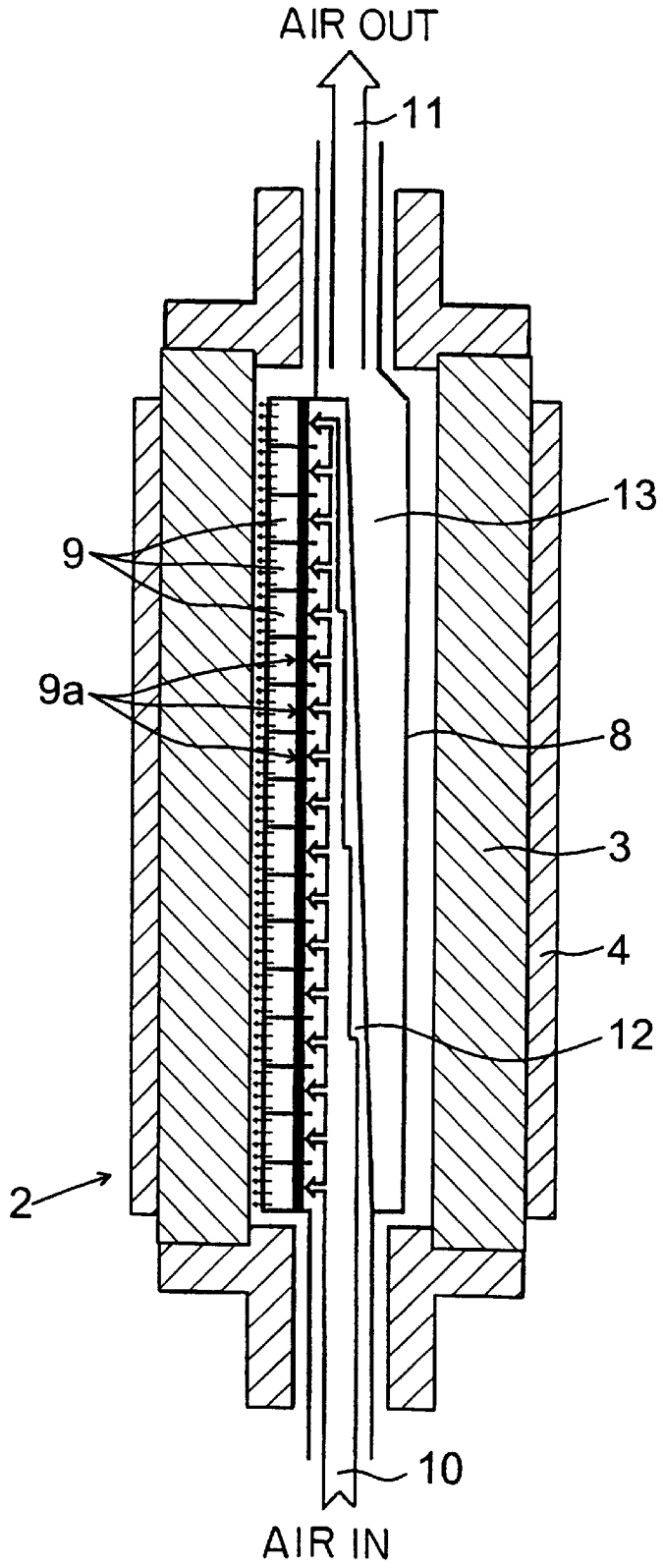
FIG. 2 shows a coated roll incorporating a temperature control device.
Figure 3:
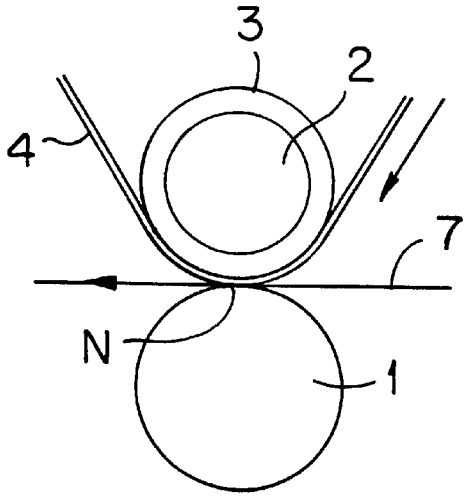
FIG. 3 is a schematic view showing the addition of a belt alternative to the present invention.
Figure 4A:
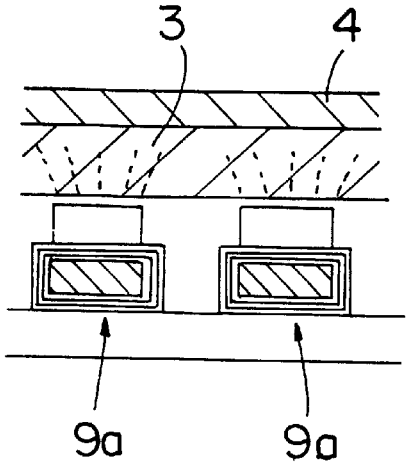
FIG. 4*a* is an enlarged elevational view showing the induction heating elements according to the present invention.
Figure 4B:
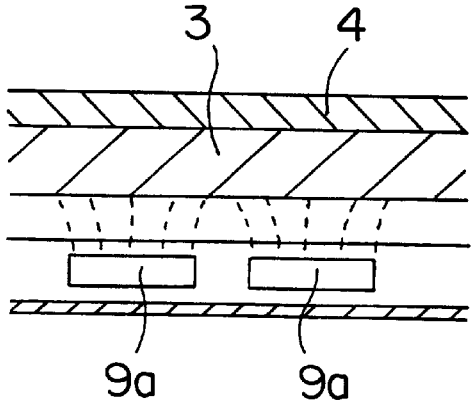
FIG. 4*b* is an enlarged elevational view showing the radiation heating elements according to the present invention.

FIG. 2 shows a roll 2 which is used for implementing the method and comprises a tubular body part 3 with a resilient coating 4 arranged on its outer surface, and a profile control device 8, adjustable in zones, arranged inside the tubular body part 3 of the roll. A heat transfer medium is supplied to the profile control device 8 via a channel 10 located at a first end of the roll 2, and the heat transfer medium is removed from the profile control device 8 via a channel 11 at the second end of the roll 2. The profile control device 8 acts as a temperature control device which, by means of separately adjustable elements contained therein, produces a desired temperature distribution in the axial direction of the roll.

The profile control device 8, which remains stationary upon rotation of the roll, comprises a first, inlet part 12 extending in the axial direction and distributing the incoming heat transfer medium used for the profiling, e.g., a gaseous medium such as air, into different, axial extending zones 9 of the inlet part 12. Each zone 9 is provided with a separate adjustable temperature control component such as an electric heat resistor element 9*a* through which the corresponding air flow is directed, producing at the zone a corresponding heating effect on the inner surface of the body part 3. The zones 9 with their resistor elements 9*a* are thermally insulated from each other, to keep the air flows separate. The incoming air flow is arranged to have such a volume rate that the heated air flows in zones at a sufficiently high rate towards the inner surface of the body part 3, e.g., at about 60 m/s, whereby a sufficient heat transfer to the body part 3 is achieved.

The heat transfer to the polymeric surface (resilient coating 4), in turn, takes place by conduction through the tubular body part 3 and then across the interface between the tubular body part 3 and the resilient material layer (coating 4) into the resilient material layer.

From the zones 9, air flows to a second part of the temperature profile control device 8, namely a collecting part 13 which extends in the axial direction and collects the local air flows that have acted over a certain sector in the direction of the periphery of the body part 3, and conveys the local air flows to the channel 11 at the other end of the roll 2.

Further, as shown in FIG. 2, the inlet part 12 tapers in the main flow direction of the incoming heat transfer medium, i.e., in the axial direction of the roll, to distribute the heat transfer medium evenly into the different zones 9.

Heat transfer from the profile control device 8 to the body 3 takes place, thanks to the flows of gaseous medium such as air, by convection. This method has the advantage of providing a sharp profiling effect, if necessary. In other words, a large difference can be obtained, if necessary, in the temperatures of adjacent zones, e.g., by heating one zone and cooling the other zone. The temperature control component may thus be a cooling element. Cooling prevents a temperature rise in an area wider than the selected heating zones. Also, the heat transfer medium to be supplied into the roll can be made cooler by cooling the medium to be taken in, when it is desired to set the lower limit of the temperature range lower than the usual temperature of the gaseous medium to be taken in. For example, if the surrounding air is used as the source of medium, it can be cooled down from its ambient temperature before it is led inside the calender roll, the advantage of which is a wider temperature range available for the profiling.

Other feasible heating alternatives include internal zonewise induction heating or internal zonewise radiation heating, e.g., by infrared heating devices.

The invention is not restricted solely to such soft-faced rolls in which the surface consists of a coating enveloping the frame circumferentially, but it can be used also in rolls in which the soft surface is made by means of a belt passed through a calender nip and being within a certain sector against the mantle of the roll.

The examples provided above are not meant to be exclusive. Many other variations of the present invention would be obvious to those skilled in the art, and are contemplated to be within the scope of the appended claims.

What is claimed is:

1. A method for calendering a paper web, comprising the steps of:

passing the paper web through a calendering nip formed by two calender rolls and having a nip profile defined by the rolls, at least one of the rolls being a soft-faced roll comprising a rotating tubular body part having an inner and an outer surface, arranging a surface layer of a resilient or polymeric material on the outer surface of the rotating tubular body part such that the resilient surface is in direct contact with the outer surface of the tubular body part, the surface layer thereby forming an interface with the rotating tubular body part, and controlling the profile of the calendering nip to compensate for defects in the paper web entering the calendering nip by arranging a profile control device along the inner surface of the tubular body part of the soft-faced roll, the profile control device having a plurality of axially extending zones arranged along an axis of the soft-faced roll and adjacent the body part, and by means of the profile control device, independently controlling the temperature of each of the zones of the rotating tubular body which in turn directly heats the resilient surface by conduction across the interface between the outer surface of the rotating tubular body part and the resilient surface to thereby enable a change in a diameter of the soft-faced roll, as a result in the temperature change of the tubular body part and the surface layer, at each of the zones independent of any change in the diameter of the soft-faced roll at other zones, wherein the step of controlling the temperature of each of the zones comprises the steps of:

directing a heat transfer medium into each of the zones, wherein said heat transfer medium is a gaseous medium; and arranging a heating element in each of the zones.

2. The method of claim 1, wherein the surface layer of resilient or polymeric material is a coating layer surrounding the body part.

3. The method of claim 1, wherein the surface layer of resilient or polymeric material is a belt arranged to run over the body part and through the nip.

4. The method of claim 1, wherein the temperature of each of the zones is controlled to cause the thickness of the surface layer at the zone to change.

5. The method of claim 1, wherein the temperature of each of the zones is controlled to cause an increase in a surface temperature of the surface layer at the zone by transfer of heat from the zones through the body part.

6. The method of claim 1, wherein the gaseous heat transfer medium is air.

7. The method of claim 6, further comprising the step of:

drawing the air from a machine hall where the web is being calendered.

8. The method of claim 1, further comprising the step of:

blowing the gaseous medium at a rate of from about 10 m/s to about 200 m/s into the roll and toward the body part of the roll.

9. The method of claim 8, wherein the gaseous medium is blown at a rate of about 30 m/s to about 60 m/s into the roll and toward the body part of the roll.

10. A method for calendering a paper web, comprising the steps of:

passing the paper web through a calendering nip formed by two calender rolls and having a nip profile defined by the rolls, at least one of the rolls being a soft-faced roll comprising a rotating tubular body part having an inner and an outer surface, arranging a surface layer of a resilient or polymeric material on the outer surface of the rotating tubular body part such that the resilient surface is in direct contact with the outer surface of the tubular body part, the surface layer thereby forming an interface with the rotating tubular body part, and controlling the profile of the calendering nip to compensate for defects in the paper web entering the calendering nip by arranging a profile control device along the inner surface of the tubular body part of the soft-faced roll, the profile control device having a plurality of axially extending zones arranged along an axis of the soft-faced roll and adjacent the body part, and by means of the profile control device, independently controlling the temperature of each of the zones of the rotating tubular body which in turn directly heats the resilient surface by conduction across the interface between the outer surface of the rotating tubular body part and the resilient surface to thereby enable a change in a diameter of the soft-faced roll, as a result in the temperature change of the tubular body part and the surface layer, at each of the zones independent of any change in the diameter of the soft-faced roll at other zones directing a gaseous heat transfer medium into each of the zones.

11. The method of claim 10, wherein the gaseous heat transfer medium is air.

12. The method of claim 11, further comprising the step of:

drawing the air from a machine hall where the web is being calendered.

13. A method for calendering a web, comprising the steps of:

passing the web through a calendering nip formed by two calender rolls and having a nip profile determined by the rolls, at least one of the rolls being a soft-faced roll comprising a tubular body part, passing a surface layer of a resilient or polymeric material through the nip between the body part and the web, and controlling the profile of the calendering nip to compensate for defects in the web entering the calendering nip by arranging a profile control device in the body part of the soft-faced roll, the profile control device having a plurality of axially extending zones arranged along an axis of the soft-faced roll and adjacent the body part, and independently controlling the temperature of each of the zones to thereby enable a change in a diameter of the soft-faced roll at each of the zones independent of any change in the diameter of the soft-faced roll at other zones, wherein the step of controlling the temperature of each of the zones comprises the steps of:

directing a heat transfer medium into each of the zones, wherein said heat transfer medium is a gaseous medium; and arranging a heating element in each of the zones.

14. The method of claim 13, wherein the gaseous heat transfer medium is air.

15. The method of claim 13, further comprising the step of:

drawing the air from a machine hall where the web is being calendered.

16. The method of claim 13, further comprising the step of:

blowing the gaseous medium at a rate of from about 10 m/s to about 200 m/s into the roll and toward the body part of the roll.

17. The method of claim 13, wherein the gaseous medium is blown at a rate of about 30 m/s to about 60 m/s into the roll and toward the body part of the roll.

* * * * *